US009659550B2

(12) United States Patent
Jasperson

(10) Patent No.: US 9,659,550 B2
(45) Date of Patent: May 23, 2017

(54) CYMBAL SIZZLE SOUND ENHANCER AND METHOD

(71) Applicant: David Jasperson, Broomfield, CO (US)

(72) Inventor: David Jasperson, Broomfield, CO (US)

( * ) Notice: Subject to any disclaimer, the term of this patent is extended or adjusted under 35 U.S.C. 154(b) by 1 day.

(21) Appl. No.: 14/745,607

(22) Filed: Jun. 22, 2015

(65) Prior Publication Data

US 2016/0372094 A1 Dec. 22, 2016

(51) Int. Cl.

| | |
|---|---|
| ***G10D 13/06*** | (2006.01) |
| ***G10D 13/08*** | (2006.01) |
| ***G10D 13/02*** | (2006.01) |

(52) U.S. Cl.

CPC ..... *G10D 13/06* (2013.01); *G10D 13/026* (2013.01); *G10D 13/065* (2013.01); *G10D 13/08* (2013.01)

(58) Field of Classification Search

CPC ..... G10D 13/06; G10D 13/08; G10D 13/026; G10D 13/065

USPC ..... 84/453, 402

See application file for complete search history.

(56) References Cited

U.S. PATENT DOCUMENTS

| | | | | | |
|---|---|---|---|---|---|
| 3,009,379 | A * | 11/1961 | Thomas | G10D 13/06 | 84/402 |
| 3,141,370 | A * | 7/1964 | Russel | G10D 13/06 | 84/402 |
| 3,677,127 | A * | 7/1972 | Garven | G10D 13/06 | 84/402 |
| 3,705,528 | A * | 12/1972 | Cordes | G10D 13/06 | 84/421 |
| 3,994,198 | A * | 11/1976 | Herman | G10D 13/06 | 84/421 |
| 4,315,453 | A | 2/1982 | Gabor et al. | | |
| 4,426,906 | A * | 1/1984 | Otto | G10D 13/06 | 84/402 |
| 2013/0098223 | A1* | 4/2013 | Coady | F16B 5/0266 | 84/421 |

* cited by examiner

*Primary Examiner* — David Warren
*Assistant Examiner* — Christina Schreiber
(74) *Attorney, Agent, or Firm* — Wessels & Arsenault, LLC; John A. Arsenault; Daniel Dubuisson

(57) ABSTRACT

A sizzle enhancer device is provided for complimentary use with a cymbal instrument to modify the sound the cymbal produces. The device reversibly fastens to the stand post above the cymbal element and includes an adjustable sizzle element which contacts and vibrates with the cymbal element to product a sizzle sound upon impact of the cymbal element with an object.

19 Claims, 3 Drawing Sheets

CYMBAL SIZZLE SOUND ENHANCER AND METHOD

STATEMENT REGARDING FEDERALLY SPONSORED RESEARCH AND DEVELOPMENT

Not Applicable.

CROSS-REFERENCE TO RELATED APPLICATIONS

Not Applicable

BACKGROUND OF DISCLOSURE

1. Field of Invention

The present invention relates to cymbal enhancements and more specifically to a device that attaches to a cymbal instrument to modify the sound produced by the cymbal upon impact with an object.

2. Description of Prior Art

Cymbals are widely utilized percussion instruments implemented in numerous musical ensembles. A variety of cymbal devices that alter the sound emitted by a cymbal have been disclosed. Otto (U.S. Pat. No. 4,426,906) discloses a cymbal sizzler construction wherein a chain comprising a plurality of interconnected metallic links, such as hollowed balls, overlies the upper surface of the cymbal element. When the cymbal element is impacted, the individual balls of the chain vibrate independently on the upper surface of the cymbal element to produce a sizzle sound. Disengagement of a chain from the cymbal element of the patent to Otto proceeds by positioning the chain so that two of the balls are secured between a pair of teeth on the elongated arm. The patent to Otto does not, however, disclose a device wherein a single adjustment can be performed to alter the sound of sizzle elements in contact with the cymbal element, nor does the patent to Otto disclose a device that properly utilizes the upper surface of the cymbal element for altering the sound emitted. Thus, it would be ideal to provide a sizzle enhancer device capable of being easily retrofitted to many types of cymbals and wherein a variety of simple adjustments may be utilized to alter the emitted sound or to disengage the sizzle elements from the cymbal element.

SUMMARY OF THE DISCLOSURE

The present invention provides an improved sizzle enhancer device capable of reversibly fastening to numerous types of cymbal instruments to alter the sound the cymbal produces.

In a primary embodiment, the sizzle enhancer device comprises an attachment assembly that secures to a stand post above the aperture of the cymbal element. One or more rods extend radially from the attachment assembly at the rod(s) proximal end portion, wherein each rod distal end portion directly connects to a chain at the proximal end portion of the chain.

In an embodiment, the distal end of the chain comprises one or more sizzle elements that further enhance the versatility of sounds the cymbal element produces.

In an embodiment, the sizzle enhancer device comprises a retaining nut that enhances the securing of the sizzle enhancer device to the stand post.

In an embodiment, the attachment assembly comprises an upper case with an outer port, a plunger with an inner port, a crown, a lower case, and an inner guide. The rod(s) protrude through the inner and outer ports and are secured in place via rod retainer(s).

In an embodiment, the attachment assembly comprises an adjustment knob, wherein rotation of the adjustment knob in a first direction adjusts the attachment assembly from a lowered configuration to a raised configuration, wherein rotation of the adjustment knob in a second direction adjusts the attachment assembly from a raised configuration to a lowered configuration.

Embodiments include one, more, or any combination of all of the features listed above.

Other features and advantages of the present invention will become apparent from the following more detailed description, taken in conjunction with the accompanying, which illustrate, by way of example, the principles of the invention.

DESCRIPTION OF THE DRAWINGS

FIG. 4*a* and FIG. 4*b* are side views of a breakdown assembly of the sizzle enhancer device in FIG. 3, wherein FIG. 4*a* is the sizzle enhancer device in a raised configuration and FIG. 4*b* is the sizzle enhancer device in a lowered configuration, in accordance with an exemplary embodiment of the present invention.

Figure 1:
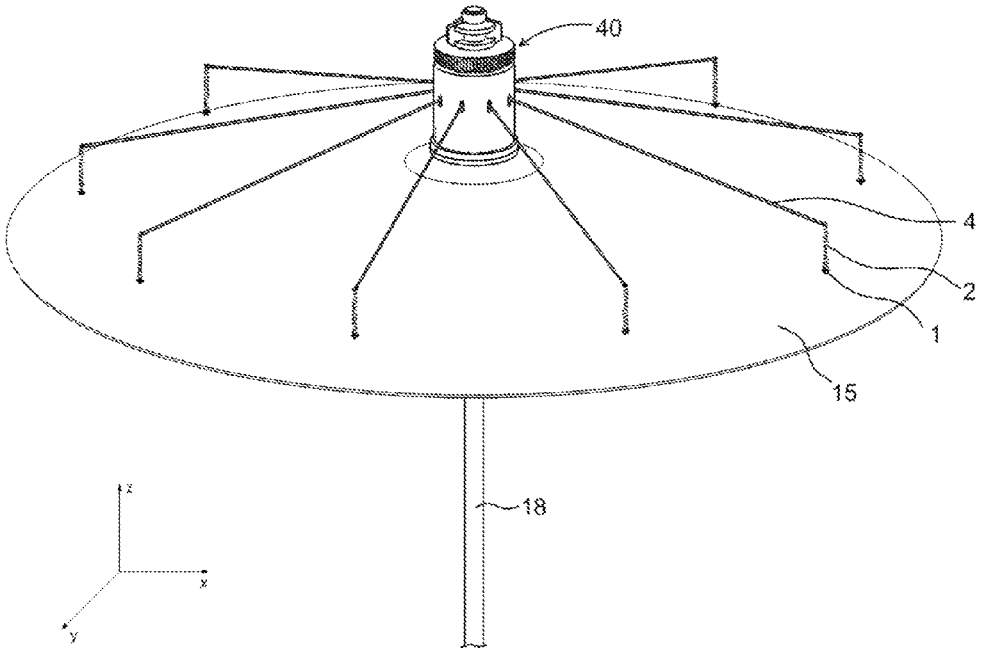
FIG. 1 is a perspective view of a sizzle enhancer device, in accordance with an exemplary embodiment of the present invention.

REFERENCE NUMERALS IN THE DRAWINGS sizzle element 1
chain 2
rod 4
rod retainer 5
adjustment knob 6
upper case 7
plunger 8
crown 9
lower case 10
inner guide 11
spring 12
screw 13
cymbal element 15
bow portion 16
bell portion 17
stand post 18
retaining nut 19
inner port 20
outer port 21
rod distal end 30
rod proximal end 31
chain distal end 32
chain proximal end 33
radial extension 34 plunger lip 37
upper case top port 38
attachment assembly 40

DETAILED DESCRIPTION OF THE DISCLOSED EMBODIMENT

Illustrative embodiments of the invention are described below in the accompanying Figures. The following detailed description provides detailed schematics for a thorough understanding of and an enabling description for these embodiments. One having ordinary skill in the art will understand that the invention may be practiced without certain details. In other instances, well-known structures and functions have not been shown or described in detail to avoid unnecessarily obscuring the description of the embodiments.

FIG. 1 is a perspective view of a sizzle enhancer device, in accordance with an exemplary embodiment of the present invention. The sizzle enhancer device is secured to the externally threaded portion of a stand post 18 adjacent to the cymbal element 15 and may be easily installed on numerous types of cymbal instruments to produce a sizzle sound upon impact of an object with the cymbal element 15. The sizzle enhancer device may be manufactured from a variety of materials exhibiting substantial rigidity, which includes but are not limited to brass, plastic, steel, aluminum, or combinations thereof.

Figure 2:
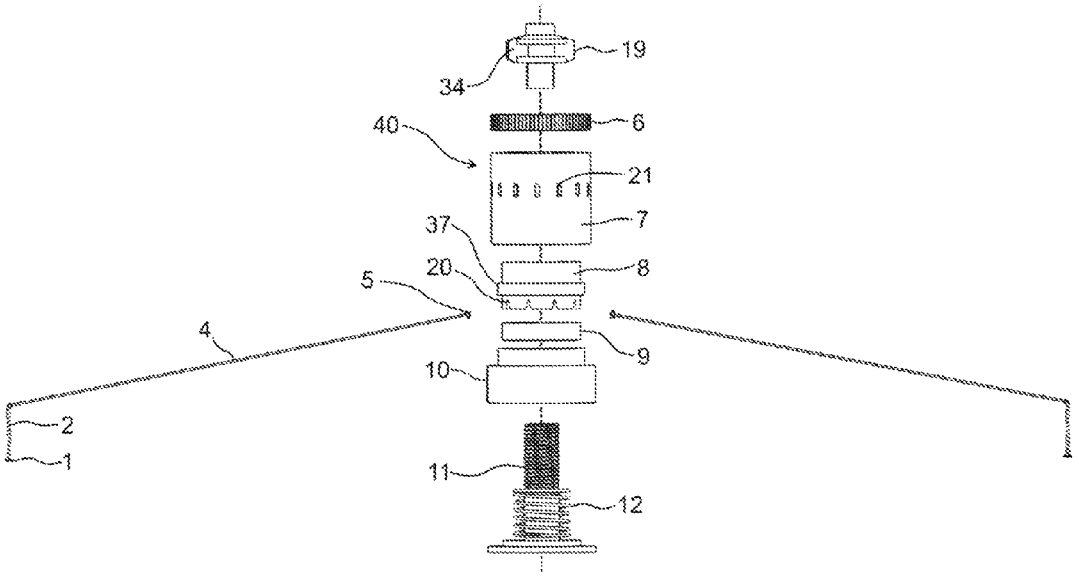
FIG. 2 is a side view of a breakdown assembly of an attachment assembly, in accordance with an exemplary embodiment of the present invention.

FIG. 2 is a side view of a breakdown assembly of an attachment assembly 40, in accordance with an exemplary embodiment of the present invention. The device is generally installed onto a cymbal instrument by insertion of the externally threaded portion of the stand post 18 located above the cymbal element 15 through an inner guide 11 of the attachment assembly 40 and fastening the internally threaded portion of a retaining nut 19 to the externally threaded portion of the stand post 18 via rotation of the retaining nut 19 relative to the stand post 18, wherein rotation of the retaining nut 19 may be facilitated by inclusion of a radial extension 34.

Figure 3:
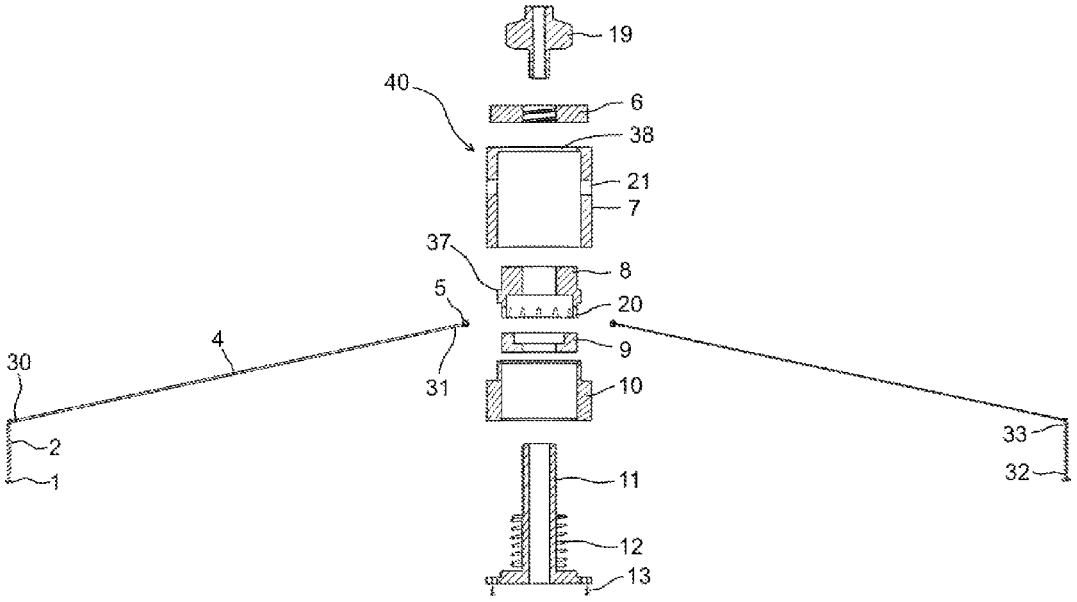
FIG. 3 is a side view of a breakdown structure of the attachment assembly in FIG. 2, in accordance with an exemplary embodiment of the present invention.

FIG. 3 is a side view of a breakdown structure of the sizzle enhancer device in FIG. 2, in accordance with an exemplary embodiment of the present invention. In this example embodiment, the attachment assembly 40 of the sizzle enhancer device comprises, centered radially about the stand post 18 or z-axis during installation, an adjustment knob 6, an upper case 7, a plunger 8, a crown 9, a lower case 10, an inner guide 11, a spring 12, and a plurality of screws 13 that secure the upper case 7 and lower case 10 to the bottom portion of the inner guide 11. The plunger 8 and crown 9 are housed within the upper case 7 and lower case 10, and the spring 12 applies a constant force to the bottom of the crown 9 which results in the top of plunger 8 being pressed firmly against the bottom of the adjustment knob 6. A plunger lip 37 extends radially from the plunger 8 and prevents the plunger 8 and crown 9 from traversing through the upper case top port 38.

One or more rods 4, or elongated arms, protrude through inner ports 20 in the plunger 8 and outer ports 21 in the upper case 7 and extend radially from the attachment assembly 40. The rods are restricted from detaching from the sizzle enhancer device via a rod retainer 5 fastened to the proximal end portion of the rod 4. The rod distal end portion 30 is fastened to the chain proximal end portion 33, wherein the chain distal end portion 32 attaches to a sizzle element 1 or contacts the cymbal element 15.

The rod 4 may take a number of forms, which include, but are not limited to, a cylindrical rod, a rod with a polygon cross sectional form, or any rod exhibiting a cross sectional area of at least partial circularity. The length of the rod 4 varies according to the diameter of the cymbal element 15 and the desired position of the distal end portion of the rod 4.

The sizzle element 1 may take a number of forms, which include, but are not limited to, a ball exhibiting at least partial sphericity, a polyhedron, or a cylinder.

The chain 2 may take a number of forms, which include, but are not limited to, a wire or collection of wires of at least partial bendability, or a collection of chain links. The chain 2 may further comprise additional sizzle elements 1.

Figure 4A:
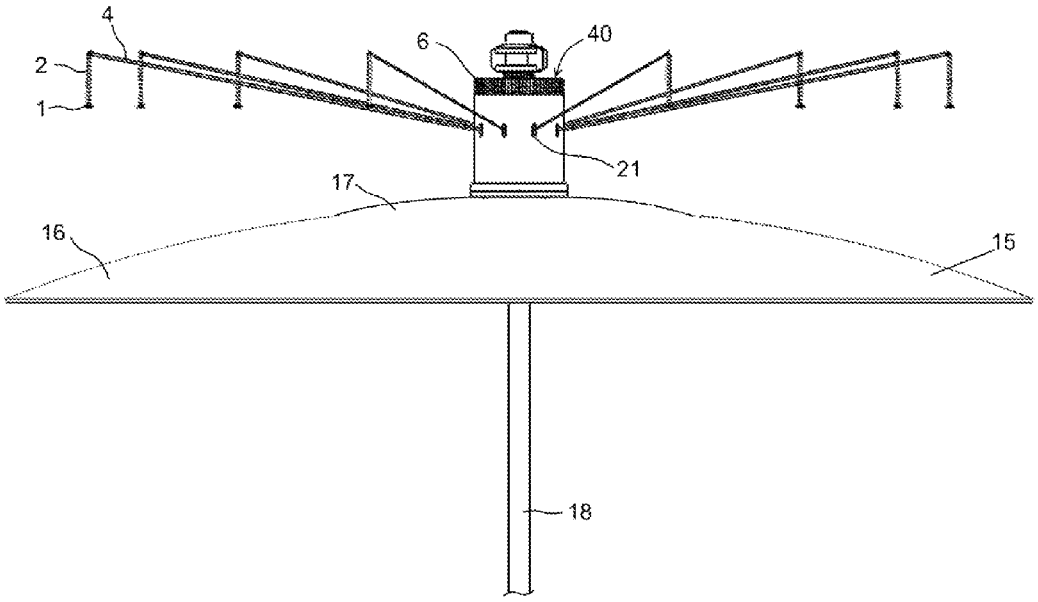
Figure 4B:
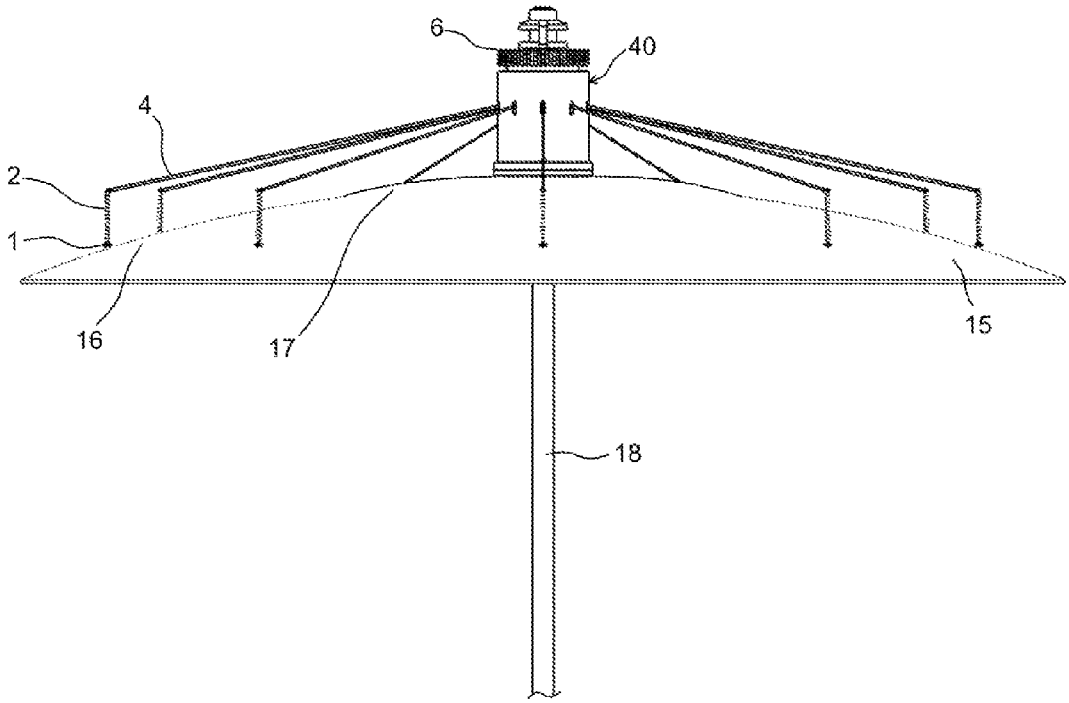

FIG. 4*a* and FIG. 4*b* are side views of a breakdown assembly of the sizzle enhancer device in FIG. 3, wherein FIG. 4*a* is the sizzle enhancer device in a raised configuration and FIG. 4*b* is the sizzle enhancer device in a lowered configuration, in accordance with an exemplary embodiment of the present invention. Adjustment knob 6 is internally threaded to match the external threading of the inner guide 11, and is rotatable in the clockwise and counterclockwise directions about the z-axis, or center of rotation, wherein rotation in a first direction raises the rod(s) 4 and eventually disengages contact of the sizzle elements 1 with the cymbal element, and rotation of the adjustment knob 6 in the second direction, opposite to the first direction, lowers the rod(s) 4 to facilitate contact of the sizzle elements 1 with the cymbal element 15. During rotation of the adjustment knob 6, the raising and lowering of rod(s) 4 is facilitated by the change in relative positions of inner port 20 and outer port 21 along the z-axis. In the lowered configuration, rotation of the adjustment knob 6 in the first direction generally alters the sizzle effect from a light sound with a long decay to a heavier sound with a shorter decay. Utilizing this method enables a user to, with little effort, adapt a cymbal instrument with the disclosed device and change between active or inactive modes, or vary the level of sizzle effect while in active mode.

Figure 5:
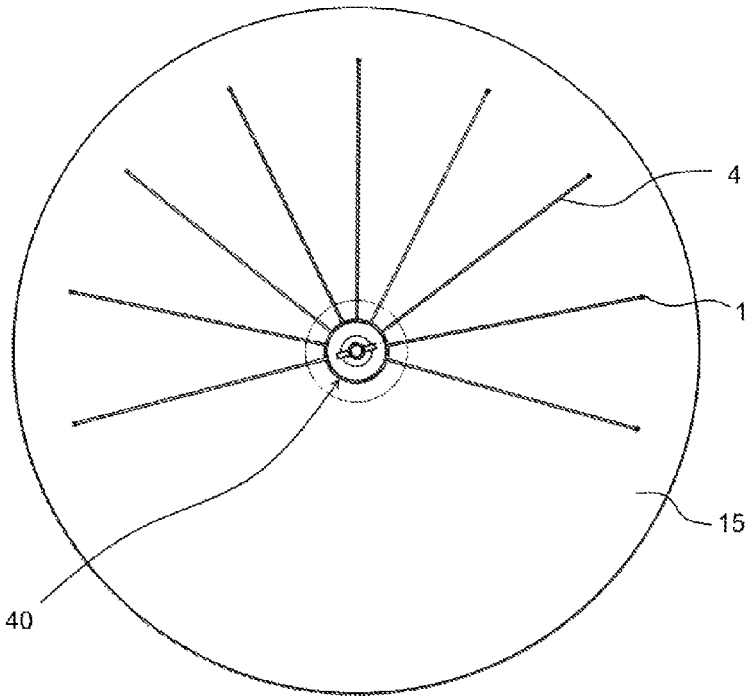
FIG. 5 is a top view of a sizzle enhancer device, in accordance with an exemplary embodiment of the present invention.

FIG. 5 is a top view of a sizzle enhancer device, in accordance with an exemplary embodiment of the present invention. The rod(s) 4 may be manufactured at any length capable of placing chain(s) 2 and any sizzle elements 1 above any portion of the cymbal element 15. In an embodiment wherein the cymbal element 15 comprises a bow portion 16 and a bell portion 17, the chain 2 and sizzle elements 1 may overly either of portion of the cymbal element 15. The rods 4 may be arranged symmetrically or asymmetrically about the stand post 18 and may be positioned equidistantly from each other.

Variation of the sound produced by the disclosed device may be achieved in several ways. The size, form, and weight of the sizzle element 1 may be varied to produce the desired sound. Furthermore, the sizzle elements 1 may further comprise an exterior coating capable of either increasing or decreasing the sizzle effect as desired by the user.

The method for using the sizzle enhancer device in combination with a cymbal element 15 and a stand post 18 generally comprises the steps of fastening an attachment assembly 40 of the sizzle enhancer device to a stand post 18 above the cymbal element 15 and impacting the cymbal element 15 with an object. The method may further comprise the step of rotating an adjustment knob 6 to alter the sound emitted by the cymbal element 15. The method may further comprise removing the sizzle enhancer device by detaching the attachment assembly 40 from the stand post 18.

While particular embodiments of the invention have been described and disclosed in the present application, it is clear that any number of permutations, modifications, or embodiments may be made without departing from the spirit and the scope of this invention. Accordingly, it is not the inventor's intention to limit this invention in this application, except as by the claims.

Particular terminology used when describing certain features or aspects of the invention should not be taken to imply that the terminology is being redefined herein to be restricted to any specific characteristics, features, or aspects of the invention with which that terminology is associated. In general, the terms used in the claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise embodiment or form disclosed herein or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

In general, the terms used in the claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

In light of the above "Detailed Description," Inventor may make changes to the invention. While the detailed description outlines possible embodiments of the invention and discloses the best mode contemplated, no matter how detailed the above appears in text, the invention may be practiced in a myriad of ways. Thus, implementation details may vary considerably while still being encompassed by the spirit of the invention as disclosed by the inventor. As discussed herein, specific terminology used when describing certain features or aspects of the invention should not be taken to imply that the terminology is being redefined herein to be restricted to any specific characteristics, features, or aspects of the invention with which that terminology is associated.

I claim:

1. A sizzle enhancer device for a cymbal instrument, wherein said cymbal instrument comprises a cymbal element and a stand post, said sizzle enhancer device comprising:

an attachment assembly reversibly attachable to said stand post above said cymbal element, said attachment assembly comprising an upper case, a plunger, a crown, a lower case, and an inner guide, wherein said upper case comprises an upper case top port and one or more outer ports, wherein said plunger comprises a plunger lip and one or more inner ports, said plunger lip extending radially from said plunger and configured to prevent said plunger and said crown from traversing through said upper case top port, said inner ports tangentially aligned with said outer ports, wherein said crown is concentrically aligned with and directly contacting said plunger, and wherein said upper case or said lower case encases said crown or said plunger; and one or more rod(s) extending radially from said attachment assembly at a rod(s) proximal end portion, wherein each said rod(s) directly connects to a chain at a chain distal end portion.

2. The sizzle enhancer device of claim 1, wherein said chain is selected from a group consisting of a wire or collection of wires of at least partial bendability, a collection of chain links, and a collection of interconnected balls.

3. The sizzle enhancer device of claim 1, wherein said rod is selected from a group consisting of a cylindrical rod, a rod exhibiting a polygon cross sectional form, and a rod exhibiting a cross sectional area of at least partial circularity.

4. The sizzle enhancer device of claim 1, wherein said chain further comprises a sizzling element at a chain distal end portion.

5. The sizzle enhancer device of claim 4, wherein said sizzler element is selected from a group consisting of a ball exhibiting at least partial sphericity, a polyhedron, and a cylinder.

6. The sizzle enhancer device of claim 4, wherein said chain further comprises one or more additional sizzle elements at said chain distal end portion.

7. The sizzle enhancer device of claim 1, wherein said attachment assembly comprises an adjustment knob, wherein rotation of said adjustment knob in a first direction adjusts said attachment assembly from a lowered configuration to a raised configuration, wherein rotation of said adjustment knob in a second direction adjusts said attachment assembly from a raised configuration to a lowered configuration.

8. The sizzle enhancer device of claim 7, wherein said attachment assembly further comprises a spring configured to apply constant force to said crown or configured to press said plunger firmly against said adjustment knob.

9. The sizzle enhancer device of claim 7, wherein said adjustment knob is internally threaded and said inner guide is externally threaded to match said adjustment knob.

10. The sizzle enhancer device of claim 1, wherein said attachment assembly further comprises one or more screws configured to secure said upper case or said lower case to a bottom portion of said inner guide.

11. The sizzle enhancer device of claim 1, wherein a plurality of said rod(s) are symmetrical about a plane of symmetry.

12. The sizzle enhancer device of claim 1, wherein said attachment assembly further comprises a retaining nut.

13. The sizzle enhancer device of claim 12, wherein said retaining nut further comprises a radial extension.

14. The sizzle enhancer device of claim 1, wherein said cymbal element comprises a bell portion and a bow portion.

15. The sizzle enhancer device of claim 14, wherein said chain overlies said bow portion.

16. The sizzle enhancer device of claim 14, wherein said chain overlies said bell portion.

17. A method for using a sizzle enhancer device in combination with a cymbal element and a stand post, said method comprising the steps of:

fastening an attachment assembly to said stand post above said cymbal element, said attachment assembly comprising an upper case, a plunger, a crown, a lower case, and an inner guide, wherein said upper case comprises an upper case top port and one or more outer ports, wherein said plunger comprises a plunger lip and one or more inner ports, said plunger lip extending radially from said plunger and configured to prevent said plunger and said crown from traversing through said upper case top port, said inner ports tangentially aligned with said outer ports, wherein said crown is concentrically aligned with and directly contacting said plunger, and wherein said upper case or said lower case encases said crown or said plunger; and impacting said cymbal element with an object.

18. The method of claim 17, further comprising the step of:

rotating an adjustment knob of said attachment assembly to alter the sound emitted by the cymbal element.

19. The method of claim 17, further comprising the step of:

removing said sizzle enhancer device by detaching said attachment assembly from said stand post.

* * * * *